US006053855A

United States Patent [19]

Stenner

[11] Patent Number: 6,053,855

[45] Date of Patent: Apr. 25, 2000

[54] DIRECT MAIL ARTICLE WITH COVER AND ONE OR MORE INTERIOR SHEETS AND INTEGRAL BUSINESS REPLY ENVELOPE

[75] Inventor: John W. Stenner, Orange, Conn.

[73] Assignee: Kurt H. Volk, Inc., Milford, Conn.

[21] Appl. No.: 09/133,996

[22] Filed: Aug. 14, 1998

[51] Int. Cl.[7] ..... B37B 1/90

[52] U.S. Cl. ..... 493/216; 493/917; 229/300; 229/92.8

[58] Field of Search ..... 493/216, 917, 493/921, 187, 192, 264; 229/300, 301, 92.8, 92.7

[56] References Cited

U.S. PATENT DOCUMENTS

| | | | |
|---|---|---|---|
| 2,517,843 | 8/1950 | Cochran . | |
| 3,275,316 | 9/1966 | Cleary, Jr. . | |
| 3,347,449 | 10/1967 | Behal . | |
| 3,520,560 | 7/1970 | Isaac | 283/56 |
| 3,907,271 | 9/1975 | Lyon, Jr. | 270/37 |
| 4,011,985 | 3/1977 | Simson | 229/68 |
| 4,520,958 | 6/1985 | Jones et al. | 229/72 |
| 4,801,076 | 1/1989 | Schoenleber et al. | 229/92.7 |
| 4,915,287 | 4/1990 | Volk et al. | 229/70 |
| 4,944,449 | 7/1990 | Schmidt | 229/73 |
| 5,015,137 | 5/1991 | Stenner | 412/1 |
| 5,169,060 | 12/1992 | Tighe et al. | 229/301 |
| 5,230,464 | 7/1993 | Schluger | 229/300 |
| 5,340,017 | 8/1994 | Tighe | 229/300 |
| 5,501,392 | 3/1996 | Kraus | 229/92.3 |
| 5,603,529 | 2/1997 | Breindel | 283/56 |
| 5,664,725 | 9/1997 | Walz | 229/92.8 |
| 5,697,547 | 12/1997 | Kraus | 229/92.1 |
| 5,797,541 | 8/1998 | Stenner | 229/300 |
| 5,959,910 | 9/1999 | Petkovsek | 229/300 |
| 5,997,457 | 12/1999 | Stenner | 493/216 |

*Primary Examiner*—Eugene L. Kim
*Attorney, Agent, or Firm*—Abelman, Frayne & Schwab

[57] ABSTRACT

A method is provided for manufacturing a personalized direct mail article requiring no envelope or other wrapper in the format of an oversized brochure having front and rear cover sheets, at least one interior sheet and a detachable preformed business reply envelope and at least one detachable reply device, all of which are joined to the cover sheets during mailing and all of which are formed from a single integral web to insure that there can be no mismatching of the several personalized elements forming the article.

12 Claims, 7 Drawing Sheets

DIRECT MAIL ARTICLE WITH COVER AND ONE OR MORE INTERIOR SHEETS AND INTEGRAL BUSINESS REPLY ENVELOPE

FIELD OF THE INVENTION

The invention relates to pre-printed direct mail articles having front and rear cover sheets and one or more interior pages.

BACKGROUND OF THE INVENTION

Traditional direct mail articles take the form of an outer envelope containing one or more lettersheets, one or more reply devices and a business reply envelope. One or more of the enclosures can be personalized with the addressee's name, address and/or other demographic information. Direct mail articles have also been produced in the form of a single over-sized sheet printed on card stock that can be transmitted through the mail without an outer envelope or other wrapper. The over-sized sheet can be provided with a preformed business reply envelope and one or more reply devices. Direct mail articles of the self-mailing type are described in U.S. patent application Ser. No. 08/449,345, now U.S. Pat. No. 5,797,541.

The over-sized format is particularly effective in promoting magazine subscriptions and the like, since the cover of a current edition or a specialized replica of the magazine's cover can be reproduced to attract the attention and appeal to the interest of the addressee as the incoming mail is being examined. Although the immediate impact of the over-sized self-mailer makes the format desirable, the information that can be provided by the sponsor of the mailing is limited by the fact that the single sheet has only the obverse of the cover page to provide relevant information or other copy to induce the addressee to favorably respond to the solicitation.

It is therefore an object of this invention to provide a novel and improved direct mail article that is a self-mailer which has a plurality of pages for receiving printed fields and that is provided with a detachable business reply envelope and one or more integral detachable reply devices that can be inserted into the reply envelope, or alternatively, that can be used independently as reply postcards, all of which elements are produced from a single integral web or sheet of paper or printable stock.

It is another object of the invention to provide a direct mail article and a method for its manufacture that comprise a pair of large letter size or over-sized cover sheets joined along an intermediate fold line in the form of a brochure containing one or more interior sheets bound to the cover sheets, and that further includes a completely preformed business reply envelope that is detachably connected to an interior sheet and at least one reply device for use by the recipient, that can be detached from one of the cover or interior sheets.

A further object of the invention is to provide an efficient method for the mass production of a self-mailing direct mail article in the form of a brochure with one or more interior sheets from which a preformed reply envelope and at least one reply device can be removed for use by the recipient.

It is yet another important object of the invention to provide an improved direct mail article as described above that can be personalized with the recipient's name, address and/or other available demographic information in printed fields located on interior pages on the detachable reply devices and reply envelope, by means of a computer-directed (computer printer during printing of the web.

SUMMARY OF THE INVENTION

The above and other objects and advantages are achieved in a preprinted personalized direct mail article comprising a front and a rear cover sheet joined along a longitudinal fold line, at least one interior sheet for carrying printed informational fields that is approximately the same size as the cover sheets, and a preformed business reply envelope ("BRE") that is detachably joined to one of the at least one interior sheets. In a preferred embodiment of the invention, at least one detachable reply device of a size that will fit easily into the pocket of the BRE is formed, as by being defined by lines of perforations, in one or both of the cover sheets, and/or in one or more of the at least one interior sheets. The at least one interior sheet and detachable BRE are bound to the interior of the cover sheets along the longitudinal fold line. The binding can be by adhesive or by wire stitching or staples.

In one preferred embodiment, the detachable BRE is joined to the interior sheet by an intermediate longitudinal strip that is contiguous to the BRE flap and front panel, and the BRE and interior sheet are bound to the inside of the cover sheets by adhesive applied to this intermediate longitudinal strip.

In order to assure the safe passage of the direct mail article of the invention through the mails, releasable edge sealing means are employed to join the cover sheets. The sealing means can include a wafer seal, beads of releasable adhesive, staples and the like.

In the preferred embodiment of the invention, the direct mail article is produced from an integral preprinted web of paper or other printable stock. If the detachable reply device is to be a self-mailable reply postcard, then the entire web stock must be of a paper board of sufficient thickness to meet the regulations of the U.S. Postal Service; or the area from which the detachable reply device is to be removed can be formed from a double thickness of adhesively bound paper in accordance with methods known in the art.

The integral web is preferably printed in several fields with the recipient's personalized information, which can include demographic references. Personalization data is preferably printed on the reply device, on the BRE, and in context in the printed fields on the cover sheets and/or on one or more pages of the at least one interior sheets.

In a further preferred embodiment, the direct mail article of the invention produced with more than one interior page. By extending the length of the preprinted integral web, additional interior panels can be accordion or fan folded, or folded by overlapping the panels to a superposed position on the interior of the cover sheets. Each additional interior panel will provide two sheets joined along a longitudinal fold line, for a total of four additional pages.

In the practice of the method of the invention to produce a direct mail article having front and rear cover sheets and a single interior sheet with a detachable BRE, the method comprises the steps of:

a. providing a preprinted web defined by transverse top and bottom edges and spaced apart longitudinal edges, a first transverse fold line between the top and bottom edges that divides the web into a cover panel and an interior panel, a longitudinal fold line between the longitudinal edges of the web that divides the cover panel into front and rear cover sheets and that divides the interior panel into an interior sheet and an envelope panel, a longitudinal envelope parting line extending between the first transverse fold line and the top edge of the web, said envelope panel comprising an envelope flap defined by a second transverse fold line, the envelope panel; and front and rear envelope panels between the second fold line and the top edge of the web;

b. separating the rear envelope panel from the interior sheet along the longitudinal envelope parting line;

c. applying adhesive to the longitudinal edges of the envelope front panel, or envelope rear panel, or both;

d. applying a remoistenable adhesive to the envelope flap;

e. perforating the longitudinal envelope parting line;

f. folding the envelope rear panel along the third transverse fold line into superposed mating contact with the envelope front panel, applying adhesive to the cover sheet proximate the longitudinal fold line, thereby bonding their longitudinal edges to form an envelope pocket;

g. folding the web along the first transverse fold line to superpose the interior sheet and preformed envelope on the cover panel;

h. securing the interior sheet and envelope to the cover panel;

i. folding the cover panel along the longitudinal fold line to position the interior sheet and preformed envelope inside the front and rear cover sheets; and j. cutting the folded web along the transverse fold line to separate the cover panel from the interior sheet and the envelope flap.

As will be understood from the above description by one of ordinary skill in the art, the one or more interior sheets can be of the same or a size different than the cover sheets, and the width of the BRE can be varied within the limitation of the width of the cover sheets. To maximize the effectiveness of the article for such uses as magazine or newspaper subscription solicitations, the cover sheets can be letter sized, or even larger. No other wrapper or cover, such as the transparent plastic film that is used with some magazines and catalogs is required, since the edges of the closed cover sheets can be joined with a releasable sealing means, such as a wafer seal.

Where more than one interior sheet is added, the bottom and top edges of the superposed panels will have to be trimmed to provide separate pages. The layout of the original integral web from which the eventual independent, personalized elements are to be formed can be varied and is well within the routine skill of the art.

BRIEF DESCRIPTION OF THE DRAWINGS

In further describing the invention, reference will be made to the drawings and the following figures in which the same number is used to refer to like elements.

DETAILED DESCRIPTION OF THE PREFERRED EMBODIMENTS

Figure 1:
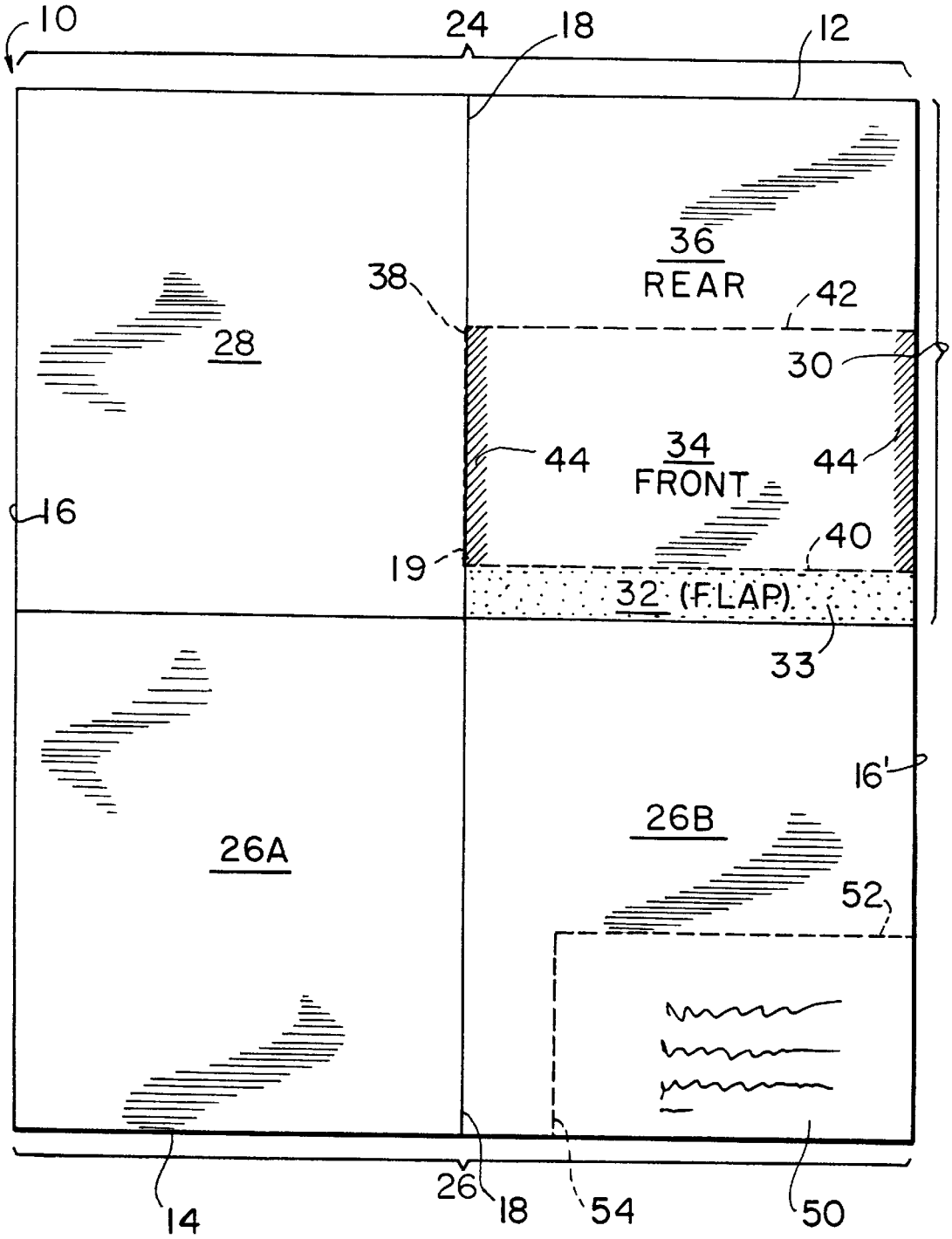
FIG. 1 is a plan view of a web for use in the method of manufacture in accordance with one preferred embodiment of the invention.

With reference to the drawings, in which like elements are referred to by the same number, FIG. 1 illustrates a web 10 of preprinted stock adapted for use in the method of the mass production of one embodiment of a direct mail article of the invention. As will be appreciated by one of ordinary skill in the art, the web 10 will be cut from a continuous web of paper (not shown) which can be in the form of a roll that can have line holes to facilitate the movement and control of the web through high speed, computer-directed printers and the subsequent processing steps which result in web 10. It will also be understood that in the practice of the method and preparation of the web or form blank 10 that the addition of elements, such as perforations, adhesive, fold lines and the like can be accomplished in sequences other than those that are specifically described below, which sequence can be dependent on factors unrelated to the invention, including the manufacturing equipment used, the layout or arrangement of the equipment, and the particular embodiment of the invention, to name but a few.

As illustrated in FIG. 1, web or form blank 10 is defined by top transverse edge 12, bottom transverse edge 14 and longitudinal edges 16, 16', and is divided by transverse fold line into upper interior panel 24 and lower cover panel 26. Longitudinal fold line 18 divides interior panel 24 into interior sheet 28 and envelope panel 30, and cover panel 26 into front and rear cover sheets 26A and 26B, respectively. As illustrated in FIG. 1, the transverse and longitudinal fold lines are positioned to provide quadrants 26A, 26B, 28 and 30 of essentially the same size. By shifting either or both of the transverse or longitudinal fold lines, the relative sizes of the interior sheet, envelope, front and rear covers can be varied; however, since all elements are produced from a single preprinted and personalized integral sheet, none of the eventually independent elements can be mismatched with differing personalized pages.

Figure 2:
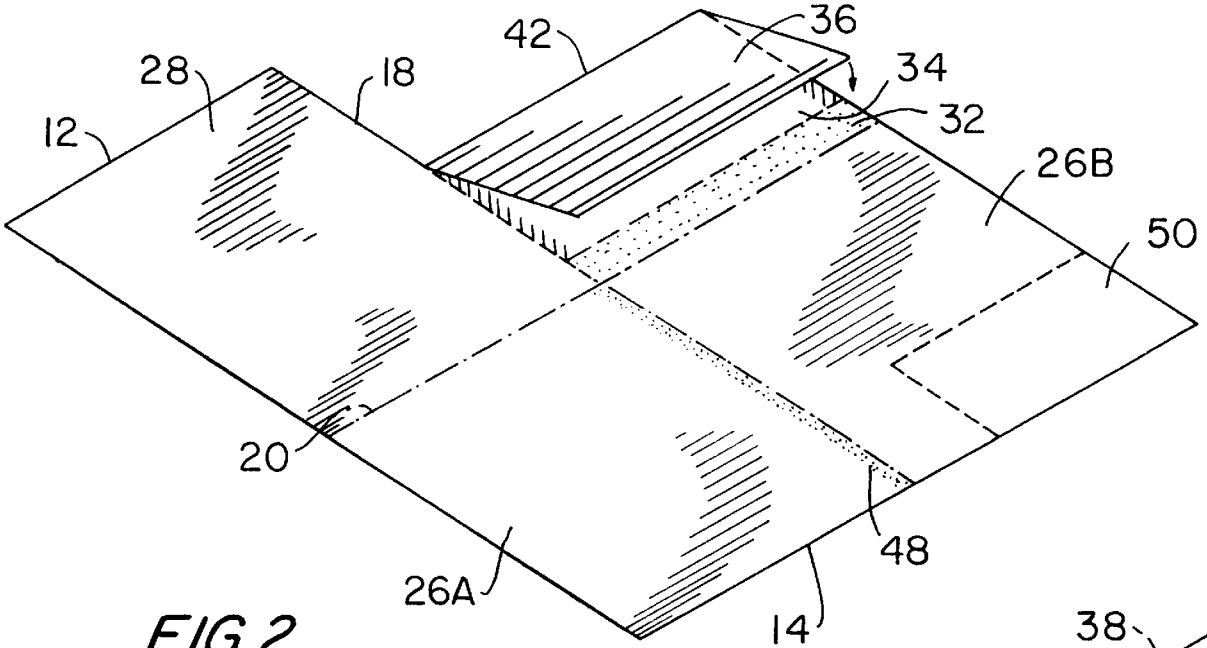
FIG. 2 is a perspective view of the web of FIG. 1 illustrating schematically an intermediate step in the manufacture.

In the practice of the method, as illustrated in FIGS. 1 and 2, envelope panel 30 is divided by fold line 40 to define a flap 32 to which remoistenable adhesive 33 is applied; and by fold line 42 into envelope front panel 34 and rear panel 36. The longitudinal edges of either the front panel 34 (as shown), or rear panel 36, or both, are provided with adhesive 44. Rear panel 36 is separated from interior sheet 28 along longitudinal envelope parting line 19, as by die-cutting, and as shown in FIG. 2, is folded into superposed position on front panel 34 to form the envelope pocket and the preformed envelope 38. Longitudinal envelope parting line 19 is also provided with perforations 37 along envelope flap 32 and front panel 34 to enable the preformed envelope 38 to be easily separated for use by the recipient. In this embodiment, the envelope parting line 19 coincides with longitudinal fold line 18.

With continued reference to FIG. 1, a reply device 50, conveniently defined by intersecting and longitudinal perforation lines 52 and 54, is positioned in the comer of rear cover sheet 26B. The reply device 50, and additional reply devices (not shown), can be similarly defined in the front cover and/or in the interior sheet 28. The size of reply device 50 relative to the pocket in preformed envelope 38, permits the recipient to place the detached reply device 50 in the envelope pocket for mailing. If it is desired to provide a self-mailable postcard reply device, the layout of web 10 is provided with an additional section or panel (not shown) that can be superposed on web 10 to provide a multiple thickness of paper bound by adhesive.

Figure 3:
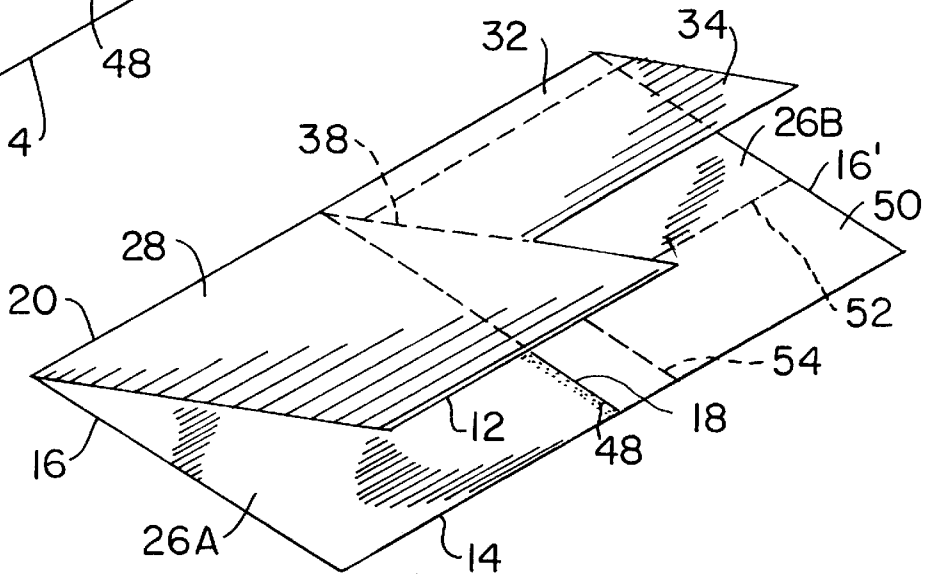
FIG. 3 is a perspective view of the web of FIG. 2 at a further intermediate step of manufacture.

Also as shown in FIG. 2, a bead of adhesive 48 is applied to front cover sheet 26A for eventual contact with interior panel 24. With reference to FIG. 3, interior sheet 28 and preformed envelope 38 are folded along transverse fold line 20 to superpose them on, and bind them to cover panel 26. In this embodiment, adhesive 48 is applied proximate longitudinal fold line 18 on the front cover panel so that preformed envelope 38 can be detached by the recipient. Alternatively, adhesive 48 can be replaced by one or more wire stitches or staples (not shown) to bind panels 24 and 26 during transit through the mail.

Figure 4:
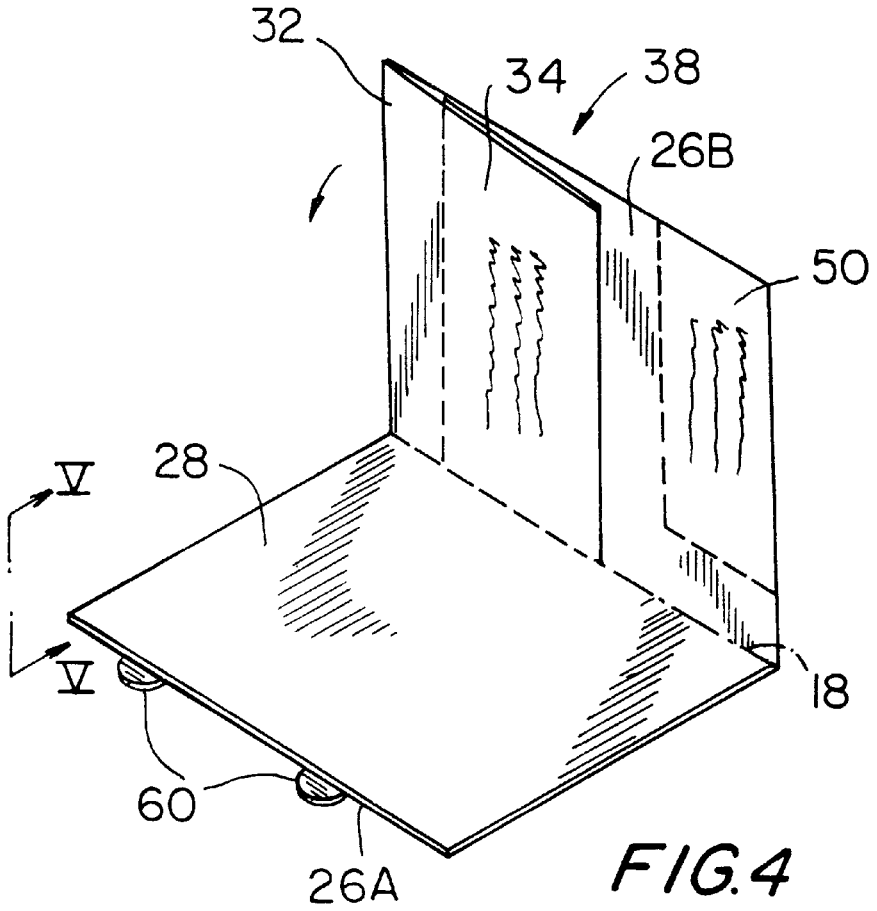
FIG. 4 is a perspective view of the web of FIG. 3 illustrating schematically a further intermediate step of manufacture.
Figure 5:
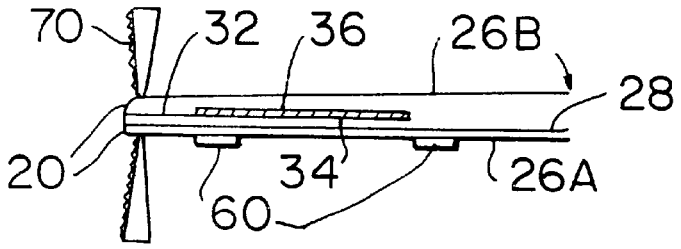
FIG. 5 is a side view taken along line V—V in FIG. 4 after the folding step has been completed and schematically illustrates the trimming along the transverse fold line.
Figure 6:
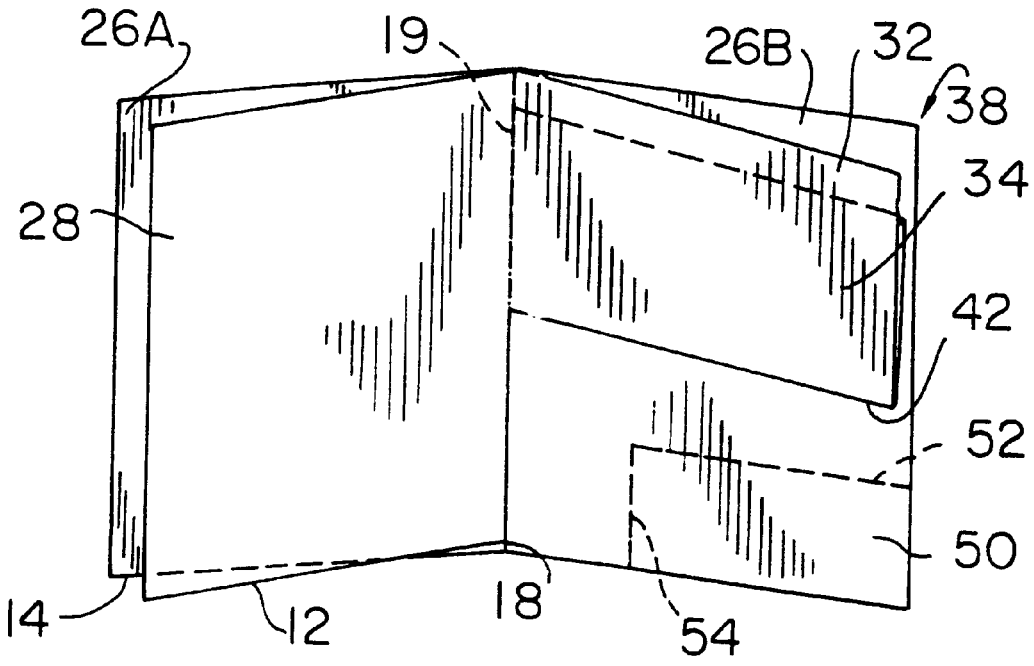
FIG. 6 is a front and top perspective view of the finished direct mail article illustrated in FIGS. 1–5.

As illustrated in FIG. 4, the superposed panels are folded along longitudinal fold line 18 to close cover sheets 26A and 26B over interior sheet 18 and envelope 38. A pair of wafer seals 60 are shown attached to, and partially extending from front cover sheet 26A. FIG. 5 illustrates the step of trimming away a narrow section of the cover sheets, envelope flap 36 and the interior sheet 28 adjacent the transverse fold line 20, using, for example, scissor wheels 70. Thereafter, the free ends of wafer seals 60 are folded to contact the rear cover sheet to secure the edges for mailing. Upon receipt, the wafer seals are severed and the covers opened to provide the article illustrated in FIG. 6. The envelope 38 is separated along longitudinal envelope parting line 19 and reply device 50 is removed along the intersecting perforation lines 52 and 54 for insertion in the envelope.

Figure 8:
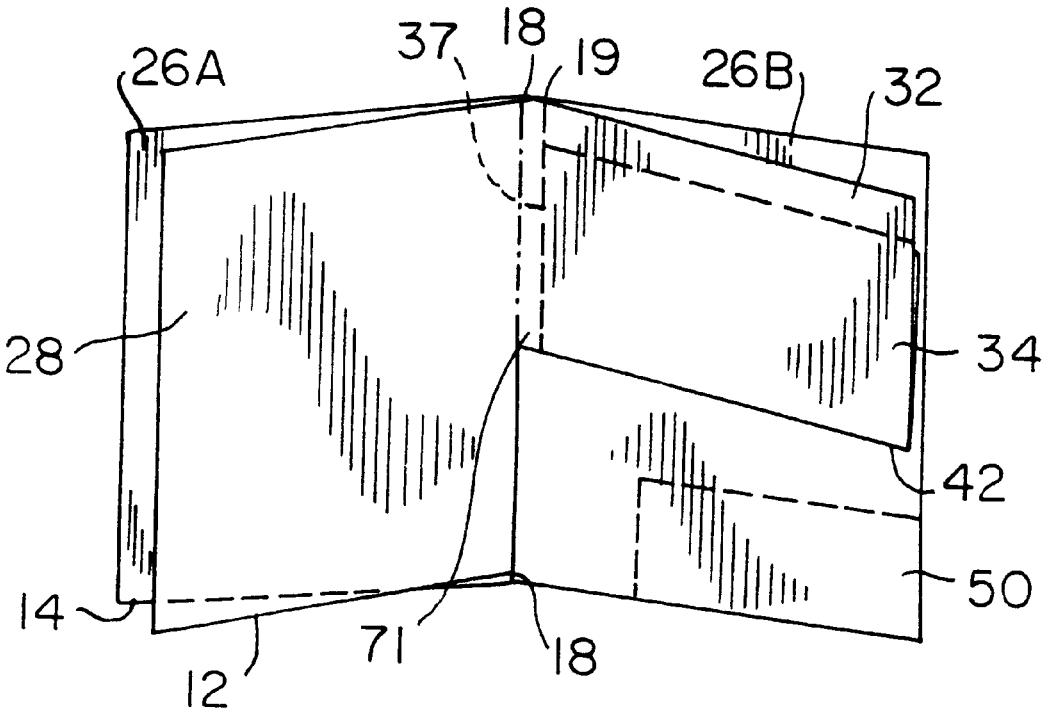
FIG. 8 is a front and top perspective view of the finished direct mail article produced from the web of FIG. 7.
Figure 7:
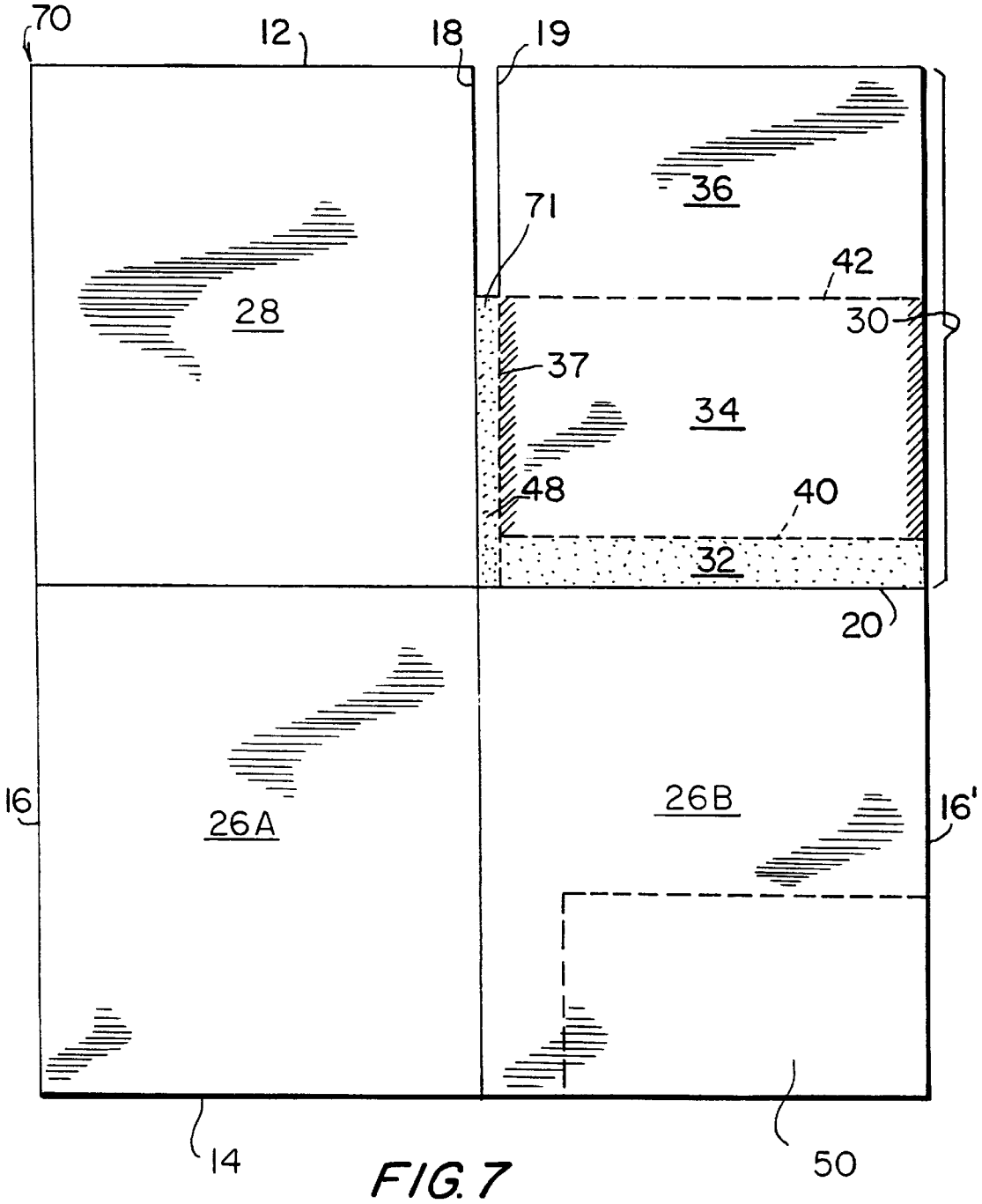
FIG. 7 is a plan view of a web for use in the manufacture of another preferred embodiment of the invention.

In a second preferred embodiment illustrated in FIGS. 7 and 8, the web 70 is provided with an envelope parting line 19 that is displaced from the longitudinal fold line 18 in the direction of the envelope panel 30, the relation and description of the other elements being essentially as set forth above in connection with FIG. 1. The section of web 70 defined by fold line 18, parting line 19, third transverse fold line 42 and top edge 12 is removed, for example, as by die cutting. Adhesive 48 is applied to the web in the area or section 71 defined by the fold line 18 and parting line 19 adjacent envelope flap 32 and front panel 34. The web is thereafter processed, folded and cut as described above in connection with FIGS. 1–6, resulting in the embodiment of the direct mail article illustrated in FIG. 8. In this embodiment, the interior sheet 28 is secured on the interior of the cover sheets 26A and 26B by virtue of its being attached to the adhesively bound section 39 of envelope panel 30. Upon receipt, envelope 38 is removed by severing along perforation line 37 in the envelope parting line 19.

Figure 9:
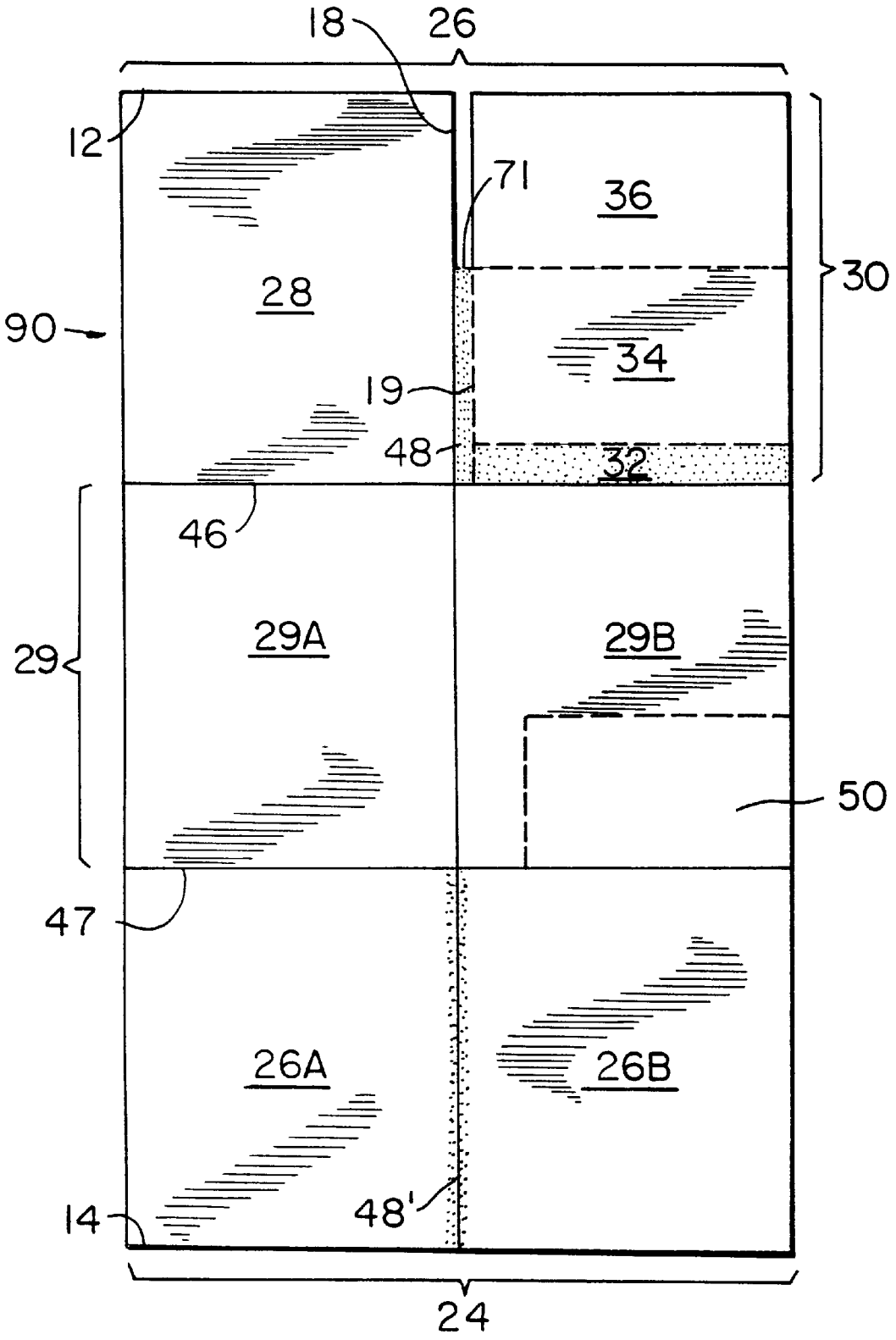
FIG. 9 is a plan view of a web for use in the method of manufacture in accordance with another preferred embodiment of the invention having a plurality of interior sheets for receiving printed informational fields.
Figure 10:
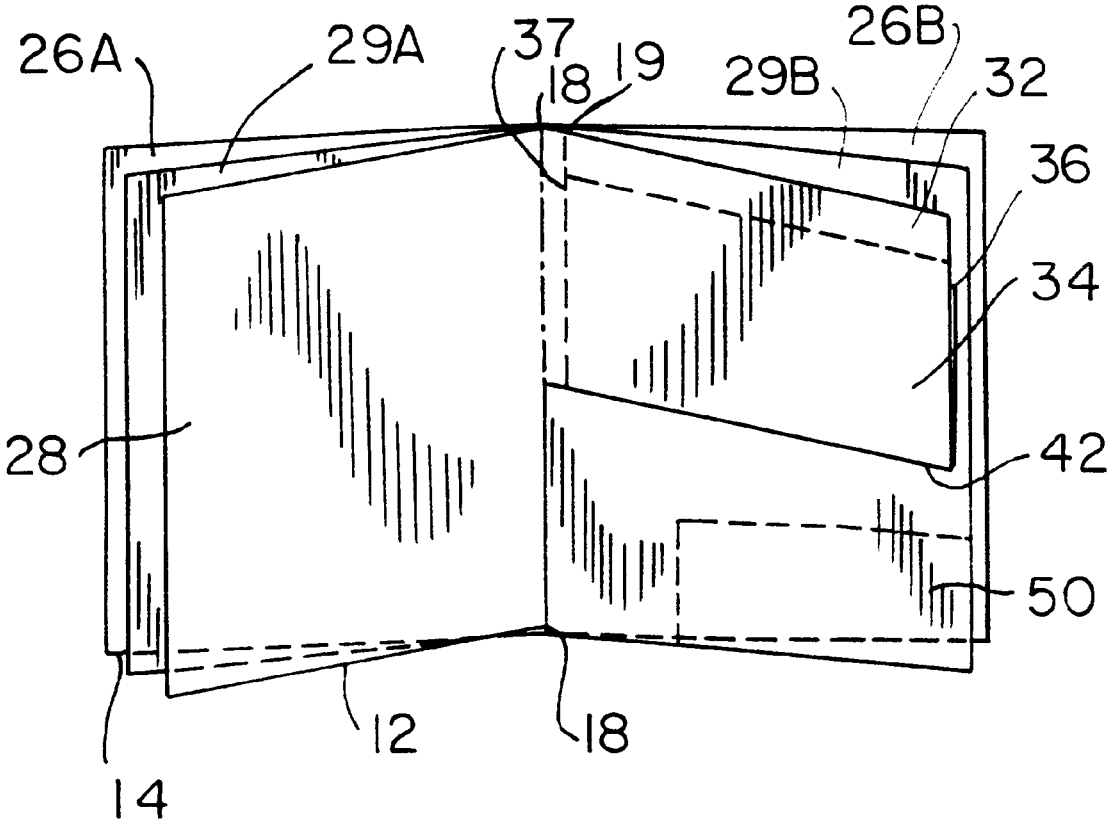
FIG. 10 is a front and top perspective view of the embodiment of the invention produced from the web of FIG. 9.

A third embodiment of the invention is illustrated in FIGS. 9 and 10, where web 90 is provided with second interior panel 29 defined by fourth and fifth transverse fold lines 46 and 47. Second interior panel 29 is comprised of second and third interior sheets, 29A and 29B, respectively, which provide four additional pages for receiving printed fields. The envelope panel 30 is configured in the same manner as described in the embodiment of FIGS. 7 and 8. Beads of adhesive 48, 48' are applied as indicated adjacent to, and along, longitudinal fold line 18.

As will be apparent to one of ordinary skill in the art, the panels 26 and 29 can either be fan folded into superposed position on the interior pages of cover panel 24, or panel 26 can be folded to align top edge 12 with fifth transverse fold line 47, followed by folding along fold line 47. Thereafter, the superposed panels are trimmed along the fold lines to separate the cover and interior sheets from each other. The embodiment shown in FIG. 10 results from fan folding of the panels to position the envelope 38 at the center fold of the folio.

I claim:

1. A method of manufacturing a preprinted multiple-sheet direct mail article consisting of a front cover sheet and a rear cover sheet joined along a longitudinal fold line and an interior sheet separably joined to a preformed BRE, the method comprising the steps of:

a. providing a preprinted web defined by transverse top and bottom edges and spaced apart longitudinal edges, a first transverse fold line between the top and bottom edges that divides the web into a cover panel and an interior panel, a longitudinal fold line between the longitudinal edges of the web that divides the cover panel into front and rear cover sheets and that divides the interior panel into an interior sheet and an envelope panel, a longitudinal envelope parting line extending between the first transverse fold line and the top edge of the web, said envelope panel comprising an envelope flap defined by a second transverse fold line, the envelope panel; and front and rear envelope panels between the second fold line and the top edge of the web;

b. separating the rear envelope panel from the interior sheet along the longitudinal envelope parting line;

c. applying adhesive to the longitudinal edges of the envelope front panel, or envelope rear panel, or both;

d. applying a remoistenable adhesive to the envelope flap;

e. perforating the longitudinal envelope parting line;

f. folding the envelope rear panel along the third transverse fold line into superposed mating contact with the envelope front panel, applying adhesive to the cover sheet proximate the longitudinal fold line, thereby bonding their longitudinal edges to form an envelope pocket;

g. folding the web along the first transverse fold line to superpose the interior sheet and preformed envelope on the cover panel;

h. securing the interior sheet and envelope to the cover panel;

i. folding the cover panel along the longitudinal fold line to position the interior sheet and preformed envelope inside the front and rear cover sheets; and j. cutting the folded web along the transverse fold line to separate the cover panel from the interior sheet and the envelope flap.

2. The method of claim 1 where the longitudinal fold line is midway between the longitudinal edges of the web.

3. The method of claim 1 where the transverse fold line is mid-way between the top and bottom edges of the web.

4. The method of claim 1 which comprises the further steps of perforating one or both of the cover sheets along a transverse parting line extending from a longitudinal edge of that cover sheet to an end point that is spaced from the longitudinal fold line; and perforating the one or both cover sheets along a longitudinal parting line extending from the end point of the transverse parting line to the bottom edge of that cover sheet to thereby define a removable reply device in one or both cover sheets.

5. The method of claim 4 where the reply device is dimensioned to be received by the envelope pocket.

6. The method of claim 1 where the longitudinal envelope parting line coincides with the longitudinal fold line.

7. The method of claim 1 where the longitudinal envelope parting line is displaced from the longitudinal fold line toward the envelope panel and the method includes the further steps of die cutting and removing a section of the envelope panel defined by the longitudinal fold line and envelope parting line and the third transverse fold line.

8. The method of claim 7, where the adhesive applied proximate the longitudinal fold line is applied between the longitudinal fold line and the longitudinal envelope parting line.

9. The method of claim 8 in which the releasable sealing means is a wafer seal.

10. The method of claim 4 which comprises the further steps of printing addressee indicia on the exterior of one of the cover sheets and printing the same addressee information on the side of the reply device lying on the interior of the cover sheet.

11. The method of claim 7 where the panels are adhesively secured in step (h) and the method comprises the further step of applying adhesive to the area of the web defined by the transverse fold line and the longitudinal fold and envelope parting lines.

12. The method of claim 1 where the panels are bound by one or more wire staples and the method of step (g) comprises the step of stapling the superposed panels.

* * * * *

UNITED STATES PATENT AND TRADEMARK OFFICE

CERTIFICATE OF CORRECTION

PATENT NO. : 6,053,855
DATED : April 25, 2000
INVENTOR(S) : John W. Stenner

It is certified that error appears in the above-identified patent and that said Letters Patent is hereby corrected as shown below:

Column 6,
Line 28, after "fold line," delete "the";
Line 29, delete "envelope panel"; and after "panels", insert -- defined by a transverse fold line --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,053,855
DATED : April 25, 2000
INVENTOR(S) : John W. Stenner

It is certified that error appears in the above-identified patent and that said Letters Patent is hereby corrected as shown below:

Column 6, claim 1,
Lines 12-56, the claim should read as follows:

-- 1. A method of manufacturing a preprinted multiple-sheet direct mail article consisting of a front cover sheet and rear cover sheet joined along a longitudinal fold line and an interior sheet separably joined to a preformed BRE, the method comprising the steps of:

a. providing a preprinted web defined by transverse top and bottom edges and spaced apart longitudinal edges, a first transverse fold line between the top and bottom edges that divides the web into a cover panel and an interior panel, longitudinal fold line between the longitudinal edges of the web that divides the cover panel into front and rear cover sheets and that divides the interior panel into an interior sheet and an envelope panel, a longitudinal envelope parting line extending between the first transverse fold line and the top edge of the web, said envelope panel comprising an envelope flap defined by a second transverse fold line, and front and rear envelope panels defined by a third transverse fold line between the second fold line and the top edge of the web;

b. separating the rear envelope panel from the interior sheet along the longitudinal envelope parting line;

c. applying adhesive to the longitudinal edges of the envelope front panel, or envelope rear panel, or both;

d. applying a remoistenable adhesive to the envelope flap;

e. perforating the longitudinal envelope parting line;

f. folding the envelope rear panel along the third transverse fold line into superposed mating contact with the envelope front panel, thereby bonding their longitudinal edges to form an envelope pocket;

g. applying adhesive to the cover sheet proximate the longitudinal fold line;

h. folding the web along the first transverse fold line to superpose the interior sheet and preformed envelope on the cover panel;

i. securing the interior sheet and envelope to the cover panel;

j. folding the cover panel along the longitudinal fold line to position the interior sheet and preformed envelope inside the front and rear cover sheets; and k. cutting the folded web along the first transverse fold line to separate the cover panel from the interior sheet and the envelope flap. --

UNITED STATES PATENT AND TRADEMARK OFFICE

CERTIFICATE OF CORRECTION

PATENT NO. : 6,053,855
DATED : April 25, 2000
INVENTOR(S) : John W. Stenner

It is certified that error appears in the above-identified patent and that said Letters Patent is hereby corrected as shown below:

Column 8, claim 9,
Lines 1-2, the claim should read as follows:

-- 9. The method of claim 8 in which a releasable sealing means is a wafer seal. --

Column 8, claim 12,
Lines 14-15, "the method of step (g) comprises the step of" should read -- step (i) comprises --.

Signed and Sealed this

Twenty-third Day of April, 2002

*Attest:*

*Attesting Officer*

JAMES E. ROGAN
*Director of the United States Patent and Trademark Office*